US012662712B2

(12) United States Patent
Yokomori et al.

(10) Patent No.: US 12,662,712 B2
(45) Date of Patent: Jun. 23, 2026

(54) CONVERTER STEELMAKING METHOD

(71) Applicant: JFE STEEL CORPORATION, Tokyo (JP)

(72) Inventors: Rei Yokomori, Tokyo (JP); Futoshi Ogasawara, Tokyo (JP); Ryo Kawabata, Tokyo (JP); Naoki Kikuchi, Tokyo (JP); Yudai Hattori, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 446 days.

(21) Appl. No.: 18/270,606

(22) PCT Filed: Dec. 17, 2021

(86) PCT No.: PCT/JP2021/046722

§ 371 (c)(1),
(2) Date: Jun. 30, 2023

(87) PCT Pub. No.: WO2022/163202

PCT Pub. Date: Aug. 4, 2022

(65) Prior Publication Data

US 2024/0068061 A1 Feb. 29, 2024

(30) Foreign Application Priority Data

Jan. 26, 2021 (JP) ..... 2021-010200

(51) Int. Cl.
*C21C 7/072* (2006.01)
*C21C 1/02* (2006.01)
(Continued)

(52) U.S. Cl.
CPC ..... *C21C 7/072* (2013.01); *C21C 1/02* (2013.01); *C21C 5/28* (2013.01); *C21C 7/068* (2013.01); *C21C 2300/08* (2013.01)

(58) Field of Classification Search
CPC .. C21C 7/072; C21C 1/02; C21C 5/28; C21C 7/068; C21C 2300/08; C21C 5/36; F27D 3/16; F27D 2003/163; Y02P 10/20
(Continued)

(56) References Cited

U.S. PATENT DOCUMENTS 4,324,584 A 4/1982 Marizy
2015/0000470 A1 1/2015 Iwaki et al.

FOREIGN PATENT DOCUMENTS

CN 104053794 A 9/2014
CN 104937116 A 9/2015
(Continued)

OTHER PUBLICATIONS

JP2005133117 Translation (Year: 2005).*
(Continued)

*Primary Examiner* — Danielle M. Carda
(74) *Attorney, Agent, or Firm* — Oliff PLC

(57) ABSTRACT

A converter steelmaking method has molten pig iron subjected to dephosphorization process for dephosphorized molten iron, dephosphorized molten iron is subjected to decarburization process for molten steel. For dephosphorization process, a first cold iron source in amount meeting Formula (1) is charged into first converter-type vessel, then undephosphorized molten pig iron is charged and subjected to dephosphorization process. Dephosphorized molten iron is discharged and held in molten metal receiving vessel. After second cold iron source is charged into first converter-type vessel in which dephosphorization process has been performed, the dephosphorized molten iron held in molten metal receiving vessel is charged and subjected to decarburization process. $\% W_{s0} \leq 0.1186T-134$ ($\% W_{s0} \geq 0$) . . . (1), where $\% W_{s0}$: a ratio (%) of first cold iron source to sum of first cold iron source and charge amount of undephospho-
(Continued)

rized molten pig iron, and T: a temperature (° C.) of undephosphorized molten pig iron.

4 Claims, 2 Drawing Sheets

(51) Int. Cl.
*C21C 5/28* (2006.01)
*C21C 7/068* (2006.01)

(58) Field of Classification Search
USPC ..... 75/528
See application file for complete search history.

(56) References Cited

FOREIGN PATENT DOCUMENTS

| | | | | |
|---|---|---|---|---|
| CN | 109652606 | A | | 4/2019 |
| JP | S63-169318 | A | | 7/1988 |
| JP | H11-217618 | A | | 8/1999 |
| JP | 2005133117 | A | * | 5/2005 |
| JP | 2006-316292 | A | | 11/2006 |
| JP | 2007-23369 | A | | 2/2007 |
| JP | 2009-256716 | A | | 11/2009 |
| JP | 2011-38142 | A | | 2/2011 |
| JP | 2011-208172 | A | | 10/2011 |
| JP | 5230062 | B2 | | 7/2013 |
| JP | 2013209738 | A | * | 10/2013 |
| JP | 2014-189841 | A | | 10/2014 |
| JP | 2018-188730 | A | | 11/2018 |
| RU | 2 620 217 | C2 | | 5/2017 |
| SU | 931754 | A1 | | 5/1982 |
| SU | 1170974 | A3 | | 7/1985 |
| TW | 201512411 | A | | 4/2015 |
| WO | 2014/112432 | A1 | | 7/2014 |

OTHER PUBLICATIONS

JP2013209738 Translation (Year: 2013).*
Mar. 19, 2024 Extended European Search Report issued in European Patent Application No. 21923206.3.
Dec. 25, 2023 Office Action Issued in Russian Patent Application No. 2023120108/05(043594).
Mar. 17, 2025 Office Action issued in Korean Patent Application No. 10-2023-7028494.
Jan. 25, 2022 International Search Report issued in International Patent Application No. PCT/JP2021/046722.
Sep. 28, 2022 Office Action issued in Japanese Patent Application No. 2022-518975.
Sep. 26, 2022 Office Action issued in Taiwanese Patent Application No. 110149069.
Oct. 9, 2025 Office Action issued in Chinese Patent Application No. 202180091524.4.

* cited by examiner 1
2
3
4
5
6
7
8
9
10
11
12

C-1
C-2
C-3

G-1
G-2
G-3
1
2
3
4
5
6
7
8
9
10
11
12
13
14

CONVERTER STEELMAKING METHOD

TECHNICAL FIELD

The present invention relates to a converter steelmaking method that allows a larger amount of cold iron source to be used in a refining process of molten iron contained in a converter-type vessel, while preventing the cold iron source from remaining unmelted.

BACKGROUND ART

In recent years, from the viewpoint of global warming, the steel industry has also been required to reduce the amount of $CO_2$ gas generation and faced an urgent need to cut down on the amount of fossil fuel used. Steel businesses manufacture molten pig iron by reducing iron ore with carbon. The carbon source needed to manufacture this molten pig iron is about 500 kg per ton of molten pig iron. On the other hand, manufacturing molten steel using a cold iron source, such as iron scrap, as a raw material in a converter does not require a carbon source that is needed to reduce iron ore. In this case, with the energy required to melt the cold iron source taken into account, replacing one ton of molten pig iron with one ton of cold iron source leads to a reduction of about 1.5 tons of $CO_2$ gas.

Increasing the amount of cold iron source, such as iron scrap, used in a converter requires supplying an amount of heat enough to sufficiently melt the cold iron source. When the amount of heat is insufficient, the cold iron source fails to melt completely during the process and remains at the bottom of the furnace after the molten metal is tapped. In this case, in a converter process of the next charge using the same converter, the mixing ratio of the molten pig iron needs to be increased to thereby reliably melt the unmelted cold iron source, so that the amount of cold iron source to be used does not increase. In addition, metallurgical disadvantages are incurred, including operational interference such as having to add molten metal in a decarburization process due to the tapped molten metal being insufficient, and, when the scull of the cold iron source adheres to the bottom of the furnace, poor stirring due to clogging of a bottom-blowing tuyere and the resulting degradation of refining performance.

In a converter process, heat absorption due to the melting of cold iron source is usually compensated by the heat of a reaction between carbon and silicon that are contained in molten pig iron as impurity elements. However, when the mixing ratio of the cold iron source increases, the amount of heat derived from carbon and silicon in the molten pig iron alone does not suffice. When melting a cold iron source, changes in temperature of molten iron during the process, particularly the first half of the process are also important. At the initial stage of melting the cold iron source, the cold iron source draws heat from the surrounding molten iron to raise its temperature, so that the temperature of the molten iron decreases rapidly. Increasing the amount of cold iron source used not only causes the temperature of the molten iron to decrease to a greater extent at an initial stage, thereby retarding the progress of melting of the cold iron source, but may also lead to formation of a huge lump of cold iron source called "steel iceberg" or "ferroberg" (hereinafter "iceberg") that is formed as the molten iron surrounding the cold iron source solidifies. Having a small area of heat transfer relative to its volume, an iceberg takes time to melt and is likely to cause the cold iron source to remain unmelted or prolong the processing time.

To supplement the insufficient amount of heat derived from carbon and silicon in molten pig iron, for example, Patent Literature 1 proposes a thermal compensation technology that supplies a heating agent such as ferrosilicon, graphite, or coke into a furnace and supplies an oxygen gas.

Also, Patent Literature 2 proposes a technology that promotes stirring of molten iron inside a converter through a supply of a bottom-blown gas and thereby facilitate melting of a cold iron source. This is to promote the heat transfer between the molten pig iron and the cold iron source and the mass transfer of carbon (a decrease in the melting point of the cold iron source through carburization from the molten iron to a surface part of the cold iron source) through enhanced stirring.

Further, Patent Literature 3 proposes a method in which, to perform a dephosphorization process of molten pig iron using a converter-type furnace having a top- and bottom-blowing function, all or part of a cold iron source is added from the furnace top to the molten pig iron during the first half of blowing.

CITATION LIST

Patent Literature

Patent Literature 1: JP2011-38142A
Patent Literature 2: JPS63-169318A
Patent Literature 3: JP2005-133117A

SUMMARY OF INVENTION

Technical Problem

In the method described in Patent Literature 1, however, supplying the oxygen gas required for oxidative combustion of carbon and silicon prolongs the processing time in the converter, resulting in lower productivity. Another problem is that when ferrosilicon is used, combustion of silicon generates $SiO_2$ and thereby adds to the amount of slag generation, while when graphite or coke is used, combustion of carbon adds to the amount of $CO_2$ gas generation.

The enhancement of stirring through bottom blowing described in Patent Literature 2 is less effective compared with thermal compensation. With the heat balance near the molten pig iron-cold iron source interface and the carbon mass balance taken into account, the melting speed of the cold iron source can be represented as a linear function of the coefficient of heat transfer at the interface or the coefficient of mass transfer of the molten iron. Here, it is known that the coefficient of heat transfer at the interface or the coefficient of mass transfer of molten iron is proportional to the 0.2 to 0.3th power of the stirring energy. Thus, even if the stirring kinetic energy is multiplied by 1.5, the melting speed would only increase by about 10%.

Further, the method described in Patent Literature 3 can avoid stagnation in melting of the cold iron source and formation of icebergs due to a decrease in temperature of the molten iron in the first half of the dephosphorization process. However, since the timing of feeding the cold iron source is limited to the first half of blowing to avoid it from remaining unmelted, the amount that can be fed within the practical blowing time is limited. In the method described in Patent Literature 3, the upper limit of the ratio of the cold iron source used is about 10%.

Having been contrived in view of these circumstances, the present invention aims to propose a converter steelmaking method that allows a larger amount of cold iron source to be used in a refining process of a cold iron source and molten pig iron contained in a converter-type vessel, while preventing the cold iron source from remaining unmelted, without compromising the productivity.

Solution to Problem

The present inventers have conducted various experiments to solve the above-described challenges. As a result, by setting an upper limit to the amount of cold iron source charged before the start of the dephosphorization process and considering the conditions for further adding a cold iron source during the dephosphorization process or the decarburization process, we have found a novel converter steelmaking method that can solve the existing challenges. The present invention has been contrived based on this finding and is summarized as follows.

A converter steelmaking method of the present invention that advantageously solves the above-described challenges has.

a step in which an auxiliary material is added, and an oxidizing gas is supplied, to a cold iron source and undephosphorized molten pig iron that are contained in a converter-type vessel, and the undephosphorized molten pig iron is subjected to a dephosphorization process to obtain dephosphorized molten iron, and the obtained dephosphorized molten iron is tapped into a molten metal receiving vessel and held in the molten metal receiving vessel; and a step in which the dephosphorized molten iron held in the molten metal receiving vessel is recharged into a first converter-type vessel in which the dephosphorization process has been performed or a second converter-type vessel different from the first converter-type vessel, and an oxidizing gas is supplied and the dephosphorized molten iron is subjected to a decarburization process to obtain molten steel.

For the dephosphorization process, after a first cold iron source in an amount meeting Formula (1) below is charged all at once into the first converter-type vessel, the undephosphorized molten pig iron is charged and subjected to the dephosphorization process, and for the decarburization process, after a second cold iron source is charged all at once into the first converter-type vessel in which the dephosphorization process has been performed or the second converter-type vessel different from the first converter-type vessel, the dephosphorized molten iron held in the molten metal receiving vessel is charged and subjected to the decarburization process:

$$\%\ W_{s0} \leq 0.1186T - 134 (\%\ W_{s0} \geq 0) \quad (1)$$

where % $W_{s0}$: a ratio (%) of a charge amount of the first cold iron source to a sum of the charge amount of the first cold iron source and a charge amount of the undephosphorized molten pig iron, and T: a temperature (° C.) of the undephosphorized molten pig iron.

In the converter steelmaking method according to the present invention, the following would be more preferable solutions:

1. During one or both of the dephosphorization process and the decarburization process, a third cold iron source is fed into the converter-type vessel from a furnace top of the converter-type vessel.
2. During one or both of the dephosphorization process and the decarburization process, the third cold iron source to be fed into the converter-type vessel from the furnace top of the converter-type vessel is fed in amounts that meet the following Formula (2):

$$W_{sadd} \leq 2.4 t_{add} \quad (2)$$

where $W_{sadd}$: a feed amount of the cold iron source (t), and $t_{add}$: for a first time of feeding from the furnace top, a time (minutes) from the start of blowing to the start of the first time of feeding, and for second and subsequent times of feeding, a time (minutes) from the completion of a preceding time of feeding to the start of a next time of feeding.

3. The longest dimension of the third cold iron source to be fed from the furnace top of the converter-type vessel is 100 mm.
4. When charging the third cold iron source from the furnace top of the converter-type vessel into the converter-type vessel during the dephosphorization process, one or both of the following conditions are met: that the concentration of carbon contained in the third cold iron source is not lower than 0.3 mass %, and that the temperature of the dephosphorized molten iron upon completion of the dephosphorization process is not lower than 1380° C.

Advantageous Effects of Invention

According to the present invention configured as described above, the dephosphorization process is performed with an upper limit set for the amount of cold iron source charged before the start of the dephosphorization process, and when performing the decarburization process by recharging the obtained dephosphorized molten iron into the converter, the cold iron source is charged all at once before the dephosphorized molten iron is charged. Thus, a decrease in temperature of the molten iron at an initial stage of the dephosphorization process is mitigated, and stagnation in melting of the cold iron source and formation of icebergs are reduced. As a result, a larger amount of cold iron source can be used in the series of processes consisting of the dephosphorization process and the decarburization process while the cold iron source is prevented from remaining unmelted. Another advantage is that the dephosphorization process can be stably performed, as poor stirring attributable to clogging of a bottom-blowing tuyere due to adhesion of the scull of the cold iron source to the bottom of the furnace and the resulting degradation of dephosphorization performance can be prevented.

Moreover, as the method of adding part of the cold iron source to be added during the dephosphorization process or the decarburization process, the cold iron source is added from the furnace top of the converter in which the process is in progress. This makes it possible to melt an even larger amount of the cold iron source in the dephosphorization process or the decarburization process while mitigating the decrease in temperature of the molten iron at an initial stage of the process and reducing stagnation in melting of the cold iron source and formation of icebergs. Here, setting the size of the cold iron source to be fed from the furnace top to 100 mm as the longest dimension can avert troubles in a furnace-top hopper and conveyance equipment, such as a conveyor, and allows the cold iron source to be stably supplied from the furnace top.

DESCRIPTION OF EMBODIMENTS

Embodiments of the present invention will be specifically described below. The drawings are schematic and may differ from the reality. The following embodiments illustrate a device and a method for implementing the technical idea of the present invention, and are not intended to limit the configuration to the one described below. That is, various changes can be made to the technical idea of the present invention within the technical scope described in the claims.

Figures 1A, 1B, 1C, 1D, 1E, 1F, 1G:
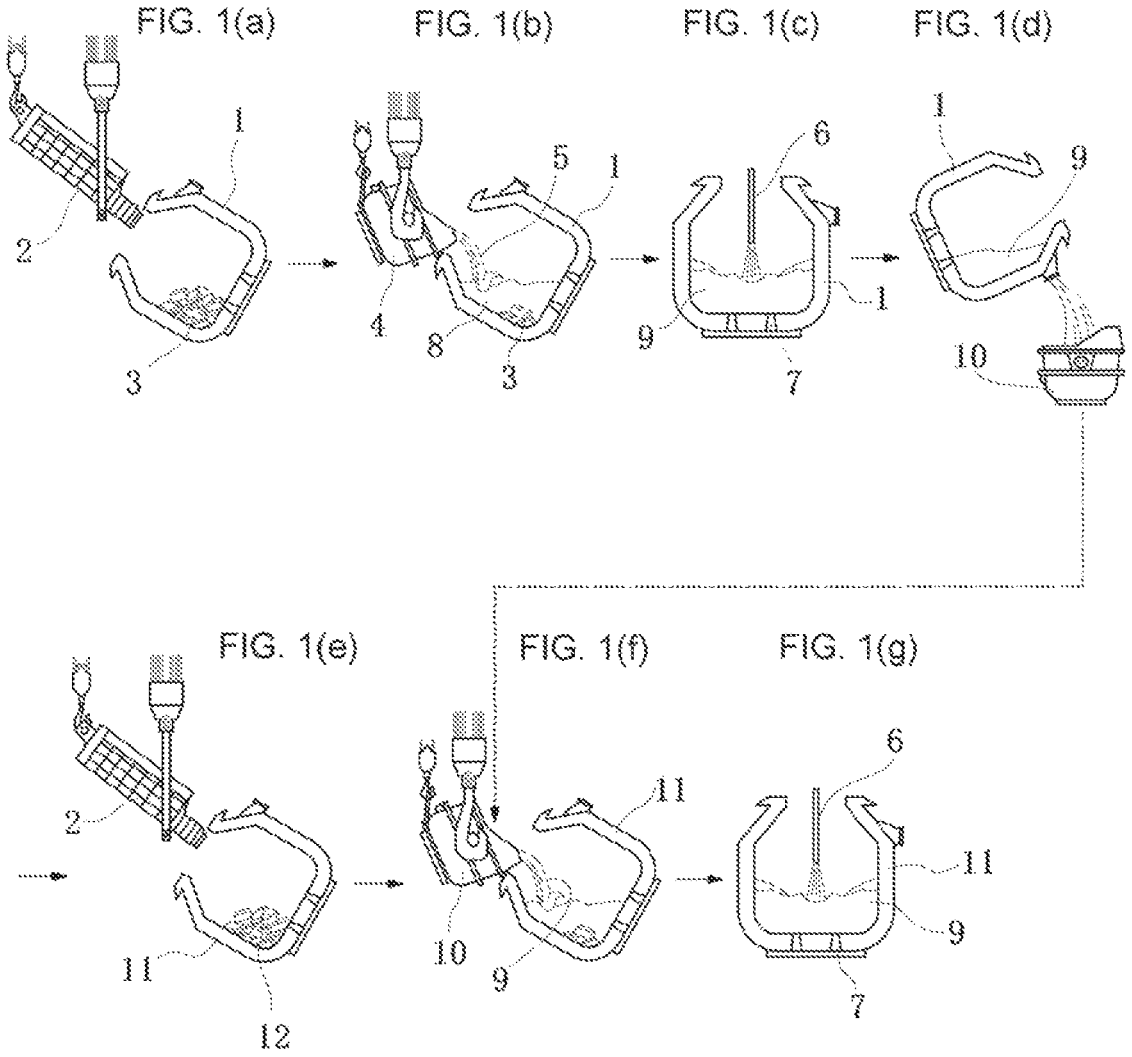
FIGS. 1(*a*) to 1(*g*) are each a view for describing one embodiment of a converter steelmaking method according to the present invention.

Description of One Embodiment of Converter Steelmaking Method of Present Invention FIGS. 1(*a*) to 1(*g*) are each a view for describing one embodiment of the converter steelmaking method according to the present invention. In the following, one embodiment of the converter steelmaking method of the present invention will be described with reference to FIGS. 1(*a*) to 1(*g*).

First, using a furnace of a converter type having a top- and bottom-blowing function (hereinafter referred to as a first converter-type vessel 1), iron scrap as a first cold iron source 3 is charged into the first converter-type vessel 1 through a scrap chute 2 (FIG. 1(*a*)). Then, using a charging pot 4, molten pig iron 5 (hereinafter also referred to as undephosphorized molten pig iron 5) is charged into the first converter-type vessel 1 (FIG. 1(*b*)). Next, an oxygen gas is supplied through a top-blowing lance 6, and an inert gas, such as $N_2$, is supplied as a stirring gas through a bottom-blowing tuyere 7 installed at the bottom of the furnace, and while auxiliary materials, such as a heating agent and a slag forming agent, are added, a dephosphorization process is performed on molten iron 8 inside the first converter-type vessel 1 to obtain dephosphorized molten iron 9 (FIG. 1(*c*)). Then, the obtained dephosphorized molten iron 9 is tapped into a molten metal receiving vessel 10 and held in the molten metal receiving vessel 10 (FIG. 1(*d*)).

A second cold iron source 12 is charged all at once into a second converter-type vessel 11 different from the first converter-type vessel 1 (FIG. 1(*e*)). Then, the dephosphorized molten iron 9 held in the molten metal receiving vessel 10 is charged into the second converter-type vessel 11 (FIG. 1(*f*)). Here, it is also possible to use the first converter-type vessel 1 in which the dephosphorization process has been performed, instead of using the second converter-type vessel 11. Finally, an oxygen gas is supplied through a top-blowing lance 6, and an inert gas, such as $N_2$, is supplied as a stirring gas through a bottom-blowing tuyere 7 installed at the bottom of the furnace, and while auxiliary materials, such as a heating agent and a slag forming agent, are added, a decarburization process is performed on the dephosphorized molten iron 9 inside the second converter-type vessel 11 (FIG. 1(*g*)). As for the amounts of cold iron source that are charged before the dephosphorization process and before the decarburization process, the total amount to be charged before both processes may be specified (a planned total charge amount of the cold iron source), and the charge amount of the second cold iron source 12 may be determined as an amount corresponding to the difference between the planned total charge amount of the cold iron source and the amount of first cold iron source 3.

According to this embodiment, setting the charge amount of the first cold iron source 3 to be charged during the dephosphorization process to an amount meeting the following Formula (1) can mitigate the decrease in temperature of the molten iron at an initial stage of the dephosphorization process and mitigate stagnation in melting of the cold iron source and formation of icebergs:

$$\%\ W_{s0} \leq 0.1186T - 134(\%\ W_{s0} \geq 0) \quad (1)$$

where % $W_{s0}$: the ratio (%) of the charge amount of the first cold iron source to the sum of the charge amount of the first cold iron source and the charge amount of the undephosphorized molten pig iron, and T: the temperature (° C.) of the undephosphorized molten pig iron There is another advantage in that the dephosphorization process can be stably performed, as poor stirring attributable to clogging of the bottom-blowing tuyere due to adhesion of the scull of the cold iron source to the bottom of the furnace and the resulting degradation of dephosphorization performance can be prevented. When performing the decarburization process by recharging the obtained dephosphorized molten iron 9 into the second converter-type vessel 11 or the first converter-type vessel 1, the decarburization process is performed by charging the second cold iron source 12 all at once before charging the dephosphorized molten iron 9. Thus, a larger amount of cold iron source can be used in the series of processes consisting of the dephosphorization process and the decarburization process while the cold iron source is prevented from remaining unmelted. Here, as for the charge amount of the second cold iron source 12 charged during the decarburization process, this amount may exceed the upper limit amount obtained from the Formula (1). This is because, in the decarburization process, the temperature of the molten metal is high compared with that in the dephosphorization process and therefore the second cold iron source 12, even when charged in a large amount, is less likely to remain unmelted.

Figures 2A, 2B, 2C, 2D, 2E, 2F, 2G:
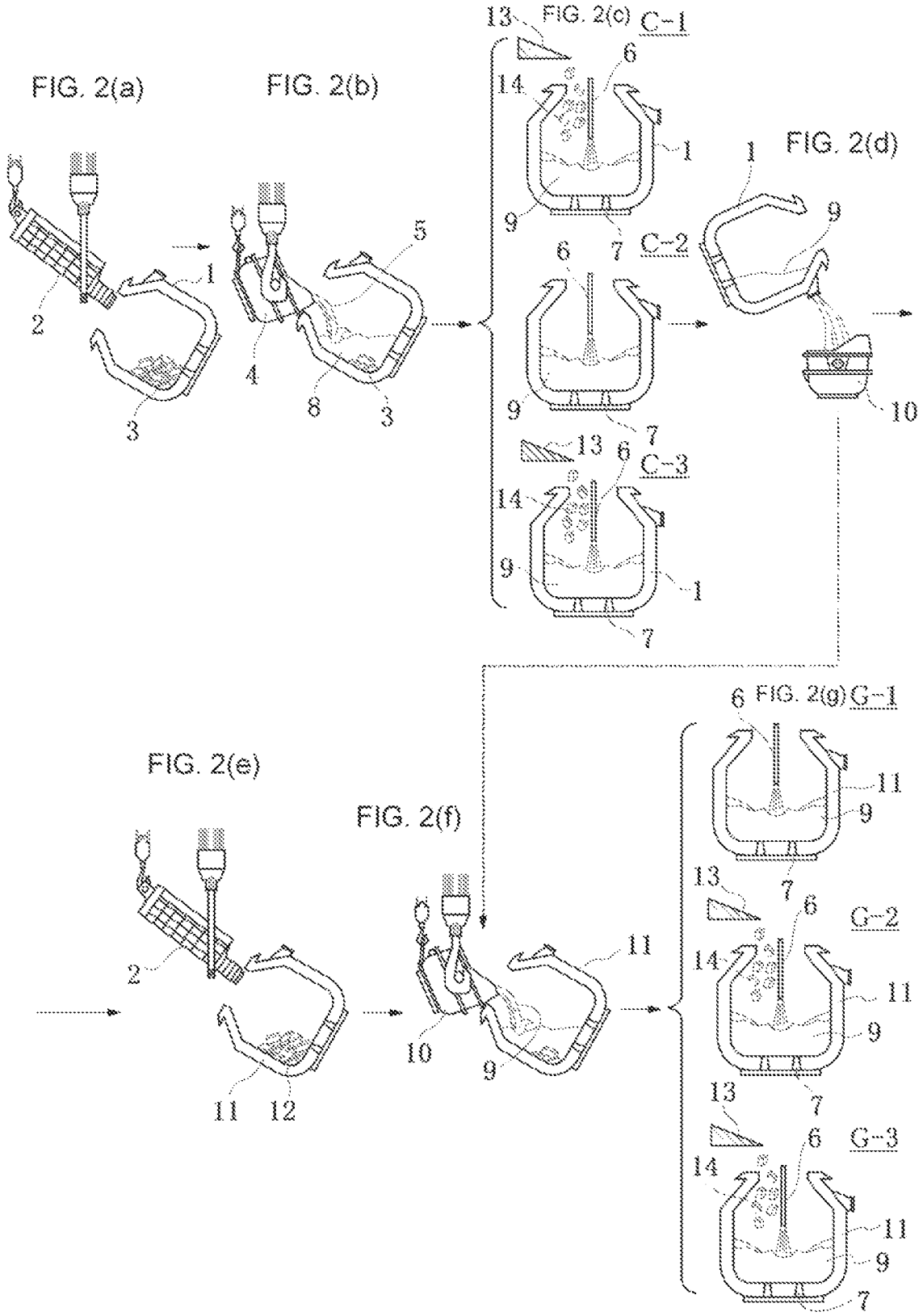
FIGS. 2(*a*) to 2(*g*) are each a view for describing another embodiment of the converter steelmaking method according to the present invention.

Description of Another Embodiment of Converter Steelmaking Method of Present Invention FIGS. 2(*a*) to 2(*g*) are each a view for describing another embodiment of the converter steelmaking method according to the present invention. In the following, another embodiment of the converter steelmaking method of the present invention will be described with reference to FIGS. 2(*a*) to 2(*g*).

First, using a first converter-type vessel 1 having a top- and bottom-blowing function, iron scrap as a first cold iron source 3 is charged into the first converter-type vessel 1 through a scrap chute 2 (FIG. 2(*a*)). Then, using a charging pot 4, undephosphorized molten pig iron 5 is charged into the first converter-type vessel 1 (FIG. 2(*b*)). These steps shown in FIG. 2(*a*) and FIG. 2(*b*) are the same as the steps described as FIG. 1(*a*) and FIG. 1(*b*) described in the first embodiment.

Next, an oxygen gas is supplied through a top-blowing lance 6, and an inert gas, such as $N_2$, is supplied as a stirring gas through a bottom-blowing tuyere 7 installed at the bottom of the furnace, and while auxiliary materials, such as a heating agent and a slag forming agent, are added, a dephosphorization process is performed on molten iron 8 inside the first converter-type vessel 1 to obtain dephosphorized molten iron 9 (FIG. 2(*c*)). Here, in this other embodiment, either of the following steps is performed: a step (C-2) in which all of the cold iron source to be used during the dephosphorization process is charged at once into the first converter-type vessel 1 as the first cold iron source 3 at the stage of FIG. 2(*a*) before the dephosphorization process, and a step (C-1, C-3) in which part of the cold iron source to be used during the dephosphorization process is charged as the first cold iron source 3 into the first converter-type vessel 1 through the scrap chute 2 before the dephosphorization process, while the rest of the cold iron source 14 is fed as the third cold iron source 14 into the first converter-type vessel 1 from the furnace top through a furnace-top hopper 13.

Then, the obtained dephosphorized molten iron 9 is tapped into a molten metal receiving vessel 10 and held in the molten metal receiving vessel 10 (FIG. 2(*d*)). Next, a second cold iron source 12 is charged all at once into a second converter-type vessel 11 different from the first converter-type vessel 1 (FIG. 2(*e*)). Then, the dephosphorized molten iron 9 held in the molten metal receiving vessel 10 is charged into the second converter-type vessel 11 (FIG. 2(*f*)). Here, it is also possible to use the first converter-type vessel 1 in which the dephosphorization process has been performed, instead of using the second converter-type vessel 11. These steps shown in FIG. 2(*d*), FIG. 2(*e*), and FIG. 2(*f*) are the same as the steps described as FIG. 1(*d*), FIG. 1(*e*), and FIG. 1(*f*) described in the first embodiment. As for the amounts of cold iron source that are used before the dephosphorization process or during the decarburization process, the total amount to be used for both processes may be specified (a planned total amount of cold iron source to be used), and the charge amount of the second cold iron source 12 may be determined as an amount corresponding to the difference between the planned total amount of cold iron source to be used and the amount of first cold iron source 3.

Finally, an oxygen gas is supplied through a top-blowing lance 6, and an inert gas, such as $N_2$, is supplied as a stirring gas through a bottom-blowing tuyere 7 installed at the bottom of the furnace, and while auxiliary materials, such as a heating agent and a slag forming agent, are added, a decarburization process is performed on the dephosphorized molten iron 9 inside the second converter-type vessel 11 (FIG. 2(*g*)). While the case (G-1) in which all of the second cold iron source 12 is charged at once into the second converter-type vessel 11 at the stage of FIG. 2(*e*) has been described here, in another embodiment, either of steps (G-2, G-3) is performed in which part of the cold iron source to be used during the decarburization process is charged as the second cold iron source 12 into the second converter-type vessel 11 through the scrap chute 2, and the rest of the cold iron source 14 is fed into the second converter-type vessel 11 from the furnace top through a furnace-top hopper 13.

In the dephosphorization step shown in FIG. 2(*c*) and the decarburization step shown in FIG. 2(*g*), when step C-1 has been performed, step G-1 is performed; when step C-2 has been performed, step G-2 is performed; and when step C-3 has been performed, step G-3 is performed. Thus, during one or both of the dephosphorization process and the decarburization process, the cold iron source is fed from the furnace top of the converter-type vessel into the converter-type vessel.

Here, in the case where the cold iron source 14 is added at one time, or divided and added multiple times, from the furnace-top hopper 13 in the dephosphorization step (C-1, C-3) shown in FIG. 2(*c*) and the decarburization step (G-2, G-3) shown in FIG. 2(*g*), it is preferable that the amount of cold iron source added from the furnace-top hopper at each time be set to an amount meeting the following Formula (2) to minimize the fall of the temperature of the molten iron:

$$W_{sadd} \leq 2.4t_{add} \tag{2}$$

where $W_{sadd}$: the feed amount of the cold iron source (t), and $t_{add}$: for the first time of feeding from the furnace top, the time (minutes) from the start of blowing to the start of the first time of feeding, and for the second and subsequent times of feeding, the time (minutes) from the completion of the preceding time of feeding to the start of the next time of feeding.

In the case where the cold iron source is added from the furnace top multiple times, setting the timing of additionally charging the cold iron source (the timing of adding for the second and subsequent times) to a timing when the cold iron source already added into the furnace melts and the temperature of the molten iron starts to rise can efficiently melt the cold iron source while reducing stagnation in melting of the cold iron source and formation of icebergs.

Further, it is desirable that the size of the cold iron source 14 to be fed from the furnace top into the furnace-top hopper 13 in the dephosphorization step (C-1, C-3) shown in FIG. 2(*c*) and the decarburization step (G-2, G-3) shown in FIG. 2(*g*) be adjusted to 100 mm or smaller as the longest dimension (a size that fits into a box with internal dimensions of 100 mm×100 mm×100 mm) by cutting etc. in consideration of the handling in the furnace-top hopper 13 and conveyance equipment, such as a conveyor. In the dephosphorization step, the third cold iron source 14 is fed from the furnace top at the timing when the first cold iron source 3 charged through the scrap chute melts as the dephosphorization process progresses and when the temperature of the molten iron starts to rise. Here, it is preferable that one or both of the following conditions be met: that the concentration of carbon contained in the third cold iron source 14 fed from the furnace top is not lower than 0.3 mass %, and that the temperature of the dephosphorized molten iron upon completion of the dephosphorization process is not lower than 1380° C. Then, the third cold iron source 14 fed from the furnace top is less likely to remain unmelted. In the decarburization step, the third cold iron source 14 is fed from the furnace top at the timing when the second cold iron source 12 charged through the scrap chute melts as the decarburization process progresses and when the temperature of the molten iron starts to rise.

The molten pig iron is not limited to molten pig iron discharged from a blast furnace. The present invention is applicable as well when the molten pig iron is molten pig iron obtained by a cupola, an induction melting furnace, an arc furnace, etc., or molten pig iron obtained by mixing such molten pig iron and molten pig iron discharged from a blast furnace.

EXAMPLES

Example 1

The amount of cold iron source in a dephosphorization process was examined. Using molten pig iron discharged from a blast furnace and a cold iron source (scrap), a molten pig iron dephosphorization process was performed in a top- and bottom-blowing converter (first converter-type vessel). The temperature of the molten pig iron and the concentration of phosphorus in the molten pig iron before the dephosphorization process were 1230 to 1263° C. and 0.130 to 0.134%, respectively. The process was performed while the charge amount of the undephosphorized molten pig iron and the amount of scrap charged through the scrap chute were changed to various amounts, and the temperature of the molten iron after the dephosphorization process was controlled to 1350° C. In this molten pig iron dephosphorization process, no cold iron source was fed from the furnace top. The result is shown in Table 1.

TABLE 1

| No. | Amount of molten iron [t] | Temperature of undephosphorized molten pig iron [° C.] | Amount of scrap fed through scrap chute [t] | Ratio of amount of serap to total charge amount [%] | Upper limit of ratio of amount of scrap calculated from Formula (1) [%] | Presence of absence of scrap remained unmelted | Phosphorous concentration after dephosphorization process [$\times 10^{-3}$%] | Remarks |
|---|---|---|---|---|---|---|---|---|
| 1 | 280 | 1230 | 35 | 11.1 | 11.9 | Absence | 26 | Invention Example |
| 2 | 265 | 1249 | 40 | 13.1 | 14.1 | Absence | 24 | Invention Example |
| 3 | 271 | 1263 | 45 | 14.2 | 15.8 | Absence | 27 | Invention Example |
| 4 | 265 | 1237 | 45 | 14.5 | 12.7 | Presence | 33 | Comparative Example |
| 5 | 269 | 1251 | 48 | 15.1 | 14.4 | Presence | 33 | Comparative Example |
| 6 | 258 | 1260 | 50 | 16.2 | 15.4 | Presence | 36 | Comparative Example |

From the result of Table 1, as shown in Test No. 1 to 6, when the amount of scrap charged through the scrap chute was set to a level exceeding the upper limit amount obtained from Formula (1), i.e., when the ratio of the amount of scrap to the total charge amount (the amount of undephosphorized molten iron+the amount of scrap having been charged through the scrap chute) exceeds 0.1186T−134 (T: the temperature of the undephosphorized molten pig iron: ° C.) (Test No. 4 to 6), not only did the scrap remain unmelted but also degradation of dephosphorization performance was recognized which was likely to be attributable to poor stirring resulting from clogging of the bottom-blowing tuyere due to adhesion of the scull of the scrap.

Example 2

Divided feeding of a cold iron source (scrap) in a decarburization process to the molten iron after the dephosphorization process of Example 1 was examined. Also in a top- and bottom-blowing converter (second converter-type vessel) in which the decarburization process was to be performed, scrap was used with the ratio of the amount of scrap to the total charge amount (the amount of undephosphorized molten pig iron+the amount of scrap having been charged through the scrap chute) set to be equal to or lower than the upper limit value obtained from Formula (1) in the dephosphorization process using the first converter-type vessel of Example 1. To minimize the decrease in temperature of the molten iron due to the use of scrap and efficiently melt the scrap, divided feeding of the scrap was performed in the second converter-type vessel (decarburization furnace). Specifically, before the molten iron was charged, the scrap was charged through the scrap chute, and then the scrap was added from the furnace top during the decarburization process. No scrap remained unmelted in the dephosphorization furnace, and the temperature of the molten iron before the decarburization process in the decarburization furnace and the temperature of the molten steel after the decarburization process were 1360 to 1380° C. and 1640 to 1650° C., respectively. The result is shown in Table 2.

TABLE 2

| No. | Amount of molten iron [t] (a) | Amount of scrap fed through scrap chute [t] | Amount of scrap fed from furnace top [t] (for one time) | Interval of feeding from furnace top [min] | Number of times of feeding from furnace top [times] | Feed amount of scrap (total with that for decarburization furnace) [t] (b) | Ratio of amount of scrap [%] (=b/(a + b)) | Presence or absence of scrap remained unmelted | Remarks |
|---|---|---|---|---|---|---|---|---|---|
| 11 | 315 | 65 | 0 | — | — | 65 | 17.1 | Absence | Invention Example |
| 12 | 325 | 60 | 15 | 7.5 | 1 | 75 | 18.8 | Absence | Invention Example |
| 13 | 323 | 65 | 15 | 6.0 | 2 | 95 | 22.7 | Absence | Invention Example |
| 14 | 328 | 65 | 12 | 6.0 | 3 | 101 | 23.5 | Absence | Invention Example |

From the result of Table 2, it was confirmed that performing divided feeding in the decarburization furnace with the amount of scrap added at each time from the furnace-top hopper set to be equal to or smaller than the upper limit value obtained from Formula (2) allowed a larger amount of scrap to be used in a stable manner. It was found that adding the scrap from the furnace top during the dephosphorization process had effects similar to those during the decarburization process.

Example 3

The dimensions of the scrap fed from the furnace top in Example 2 were examined. The dimensions of the scrap to be fed from the furnace top were changed in Example 2. As shown in Test No. 21 to 23 in Table 3 below, it was found that setting the dimensions of the scrap to a size of 100 mm or smaller as the longest dimension (a size that fits into a box with internal dimensions of 100 mm×100 mm×100 mm) allowed the scrap to be stably fed from the furnace top without causing trouble in the conveyance system, such as the conveyor.

TABLE 3

| No. | Dimensions of scrap fed from furnace top [mm] | Presence or absence of trouble in conveyance system | Remarks |
|---|---|---|---|
| 21 | 150 × 150 × 150 | Presence | Comparative Example |
| 22 | 110 × 110 × 110 | Presence | Comparative Example |
| 23 | 90 × 90 × 90 | Absence | Invention Example |

Example 4

Feeding of scrap from the furnace top in the latter half of the dephosphorization process was examined. Feeding of scrap from the furnace top was performed only once after the start of the process, with the amount of scrap to be charged through the scrap chute (the pre-charge amount of the scrap) set to be equal to or smaller than the upper limit value obtained from Formula (1). The temperature of the molten pig iron before the dephosphorization process was 1250 to 1260° C., and the upper limit value of the pre-charge amount of the scrap that is obtained from Formula (1) is 14.5 to 15.6%. The timing of feeding the scrap from the furnace top was when the degree of progress of blowing was 65 to 75%. The result is shown in Table 4.

TABLE 4

| No | Amount of molten iron [t] | Amount of scrap fed through scrap chute [t] | Ratio of pre-charge amount of scrap to total charge amount [%] | Amount of scrap added from furnace top [t] | Concentration of C in scrap added from above [wt %] | Temperature of molten iron upon completion of dephosphorization [° C.] | Presence or absence of scrap remained unmelted | Remarks |
|---|---|---|---|---|---|---|---|---|
| 31 | 271 | 35 | 11.4 | 10 | 0.3 | 1374 | Absence | Invention Example |
| 32 | 262 | 30 | 10.3 | 10 | 0.0 | 1385 | Absence | Invention Example |
| 33 | 279 | 35 | 11.1 | 10 | 0.5 | 1382 | Absence | Invention Example |
| 34 | 272 | 35 | 11.4 | 10 | 0.0 | 1371 | Presence | Comparative Example |

From the result of Table 4, it was found that also when the scrap was fed from the furnace top during the latter half of the dephosphorization process, the scrap was less likely to remain unmelted when one or both of the following conditions were met: that the concentration of carbon contained in the scrap to be fed from the furnace top was not lower than 0.3 mass %, and that the temperature of the dephosphorized molten iron upon completion of the dephosphorization process was not lower than 1380° C.

In the above-described Examples, the example of performing the processes using molten pig iron discharged from a blast furnace and a cold iron source (scrap) has been shown, but the molten pig iron is not limited to molten pig iron discharged from a blast furnace. The present invention is applicable as well when the molten pig iron is molten pig iron obtained by a cupola, an induction melting furnace, an arc furnace, etc., or molten pig iron obtained by mixing such molten pig iron and molten pig iron discharged from a blast furnace.

INDUSTRIAL APPLICABILITY

The converter steelmaking method of the present invention is industrially useful, as this technology is applicable to any methods that obtain molten steel by refining molten pig iron in a converter using a cold iron source.

REFERENCE SIGNS LIST

1 First converter-type vessel
2 Scrap chute
3 First cold iron source
4 Charging pot
5 (Undephosphorized) molten pig iron
6 Top-blowing lance
7 Bottom-blowing tuyere
8 Molten iron
9 (Dephosphorized) molten iron
10 Molten metal receiving vessel
11 Second converter-type vessel
12 Second cold iron source
13 Furnace-top hopper
14 Cold iron source added from furnace top

The invention claimed is:

1. A converter steelmaking method comprising:

a step in which an auxiliary material is added, and an oxidizing gas is supplied, to a cold iron source and undephosphorized molten pig iron that are contained in a converter vessel, and the undephosphorized molten pig iron is subjected to a dephosphorization process to obtain dephosphorized molten iron, and the obtained dephosphorized molten iron is tapped into a molten metal receiving vessel and held in the molten metal receiving vessel; and a step in which the dephosphorized molten iron held in the molten metal receiving vessel is recharged into a first converter vessel in which the dephosphorization process has been performed or a second converter vessel different from the first converter vessel, and an oxidizing gas is supplied and the dephosphorized molten iron is subjected to a decarburization process to obtain molten steel, wherein:

for the dephosphorization process, after a first cold iron source in an amount meeting Formula (1) below is charged all at once into the first converter vessel, the undephosphorized molten pig iron is charged and subjected to the dephosphorization process;

for the decarburization process, after a second cold iron source is charged all at once into the first converter vessel in which the dephosphorization process has been performed or the second converter vessel different from the first converter vessel, the dephosphorized molten iron held in the molten metal receiving vessel is charged and subjected to the decarburization process:

$$\% \ W_{s0} \leq 0.1186T - 134 \quad (1)$$

where % $W_{s0} \geq 0$ and % $W_{s0}$: a ratio (%) of a charge amount of the first cold iron source to a sum of the charge amount of the first cold iron source and a charge amount of the undephosphorized molten pig iron, and T: a temperature, in ° C., of the undephosphorized molten pig iron;

during one or both of the dephosphorization process and the decarburization process, a third cold iron source is fed into the converter vessel from a furnace top of the converter vessel; and a longest dimension of the third cold iron source to be fed from the furnace top of the converter vessel is 90 mm.

2. The converter steelmaking method according to claim 1, wherein, during one or both of the dephosphorization process and the decarburization process, the third cold iron source to be fed into the converter vessel from the furnace top of the converter vessel is fed in amounts that meet Formula (2) below:

$$W_{sadd} \leq 2.4t_{add} \quad (2)$$

where $W_{sadd}$: a feed amount of the cold iron source (t), and $t_{add}$: for a first time of feeding from the furnace top, a time, in minutes, from the start of blowing to the start of the first time of feeding, and for second and subsequent times of feeding, a time, in minutes, from the completion of a preceding time of feeding to the start of a next time of feeding.

3. The converter steelmaking method according to claim 2, wherein, when charging the third cold iron source from the furnace top of the converter vessel into the converter vessel during the dephosphorization process, one or both of the following conditions are met: that the concentration of carbon contained in the third cold iron source is not lower than 0.3 mass %, and that the temperature of the dephosphorized molten iron upon completion of the dephosphorization process is not lower than 1380° C.

4. The converter steelmaking method according to claim 1, wherein, when charging the third cold iron source from the furnace top of the converter vessel into the converter vessel during the dephosphorization process, one or both of the following conditions are met: that the concentration of carbon contained in the third cold iron source is not lower than 0.3 mass %, and that the temperature of the dephosphorized molten iron upon completion of the dephosphorization process is not lower than 1380° C.

* * * * *